United States Patent [19]

van Lent

[11] 3,947,718

[45] Mar. 30, 1976

[54] SHADOW MASK HAVING ELONGATED APERTURES CONCAVE TO VERTICAL CENTER LINE AND INCREASING IN PITCH ALONG X-AXIS WITH DISTANCE FROM SAID LINE

[75] Inventor: Johannes Gerardus van Lent, Eindhoven, Netherlands

[73] Assignee: U.S. Philips Corporation, New York, N.Y.

[22] Filed: Feb. 14, 1974

[21] Appl. No.: 442,655

[30] Foreign Application Priority Data

Mar. 6, 1973 Netherlands ..... 7303077

[52] U.S. Cl. ..... 313/408; 313/403

[51] Int. Cl.[2] ..... H01J 29/07; H01J 31/20

[58] Field of Search ..... 313/403, 402, 408, 458

[56] References Cited

UNITED STATES PATENTS

| | | | |
|---|---|---|---|
| 3,652,895 | 3/1972 | Tsuneta et al. | 313/403 |
| 3,731,129 | 5/1973 | Tsuneta et al. | 313/408 |
| 3,777,204 | 12/1973 | Robbins et al. | 313/403 |
| 3,889,145 | 6/1975 | Suzuki et al. | 313/403 X |

*Primary Examiner*—Robert Segal

*Attorney, Agent, or Firm*—Frank R. Trifari; George B. Berka

[57] ABSTRACT

The display screen of a colour cathode ray tube comprises a line pattern of elongated phosphor regions. The elongate apertures in the shadow mask having the shape of an approximately spherical sector are arranged along curved lines which during the manufacture of the tube are aligned in one flat plane with the central axis of a linear light source located in the deflection region.

1 Claim, 5 Drawing Figures

Figure 1:
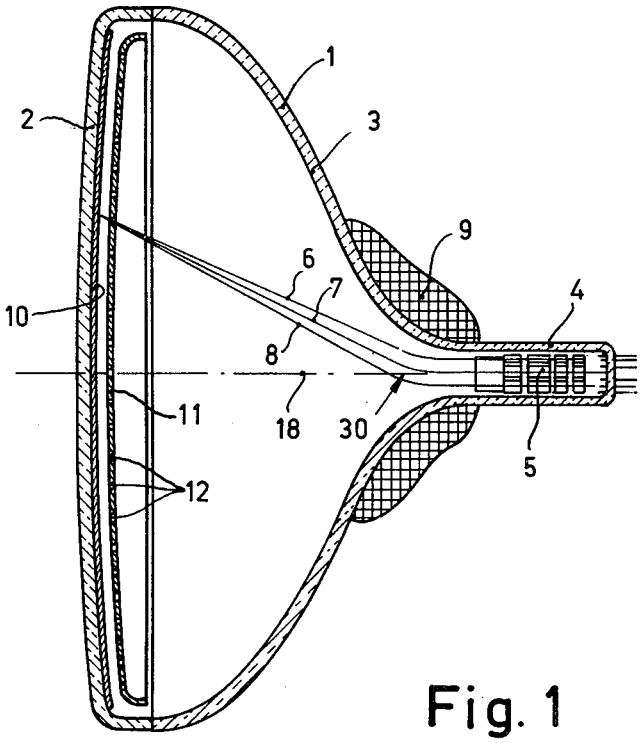

SHADOW MASK HAVING ELONGATED APERTURES CONCAVE TO VERTICAL CENTER LINE AND INCREASING IN PITCH ALONG X-AXIS WITH DISTANCE FROM SAID LINE

The invention relates to a cathode-ray tube for displaying coloured pictures comprising in an evacuated envelope means to generate at least two electron beams the axes of which are located in a flat plane, a display screen comprising a large number of linear regions luminescing in at least two different colours, and a colour selection electrode which is curved in two directions and comprises a large number of elongate apertures which are arranged in rows corresponding to the said linear luminescing regions, said electron beams being each associated with luminescent regions of one colour by means of the said colour selection electrode.

Such a cathode-ray tube is known from the U.S. Pat. No. 2,690,518. The linear luminescent regions are generally provided by means of a photochemical method in which a photosensitive layer is exposed to the light of a light source through the apertures in the colour selection electrode. It has been found that an elongate light source, whose length direction is substantially parallel to the linear luminescent regions, can best be used for this purpose. The rows of elongate apertures are parallel in the known tube, which means that their center lines on the curved colour selection electrode lie in planes which are parallel to each other and to the main axis of the tube.

It has now been found that with such a colour selection electrode the said elongate light source yields linear luminescent regions whose edges are undulated. It is the object of the invention to provide a cathode-ray tube of the type mentioned in the first paragraph in which the linear luminescent regions have substantially straight edges.

According to the invention, a cathode ray tube of the type mentioned in the first paragraph is characterized in that the center line of each of the said rows of apertures is located substantially in a transverse flat plane coinciding with a line which, in the deflection region of the said electron beams, intersects the said normally horizontal flat plane through the electron beams at right angles.

The invention is based on the recognition of the fact that in the case of parallel rows of elongate apertures in the colour selection electrode the reproductions on the said photosensitive layer of the apertures which are located in the elongation of each other enclose a small angle with the center line of the reproduction of the whole row. It has been found that this is caused by the curvature of the colour selection electrode. As a result of this the linear luminescent region which is formed by a succession of said reproductions contains a more or less undulating edge. The invention prevents this by arranging each elongate aperture of a row in one flat plane coinciding with the axis of the elongate light source. As is known, the light source must be arranged in the deflection point of the relevant electron beam so as to obtain a good correspondance of the luminescent regions with the spots of the electron beams. In connection herewith, the center line of each row of apertures should be located substantially in one plane with a line which, in the deflection region, intersects the plane through the electron beams at right angles.

A favourable construction of the colour selection electrode is such that the pitch between the said rows of apertures increases from the center of the colour selection electrode towards the edge measured along a line through the said center and at right angles to the said rows. As a result of this it is prevented that the pitch in the corners becomes needlessly small, which is detrimental to the colour purity at that area.

Figure 2:
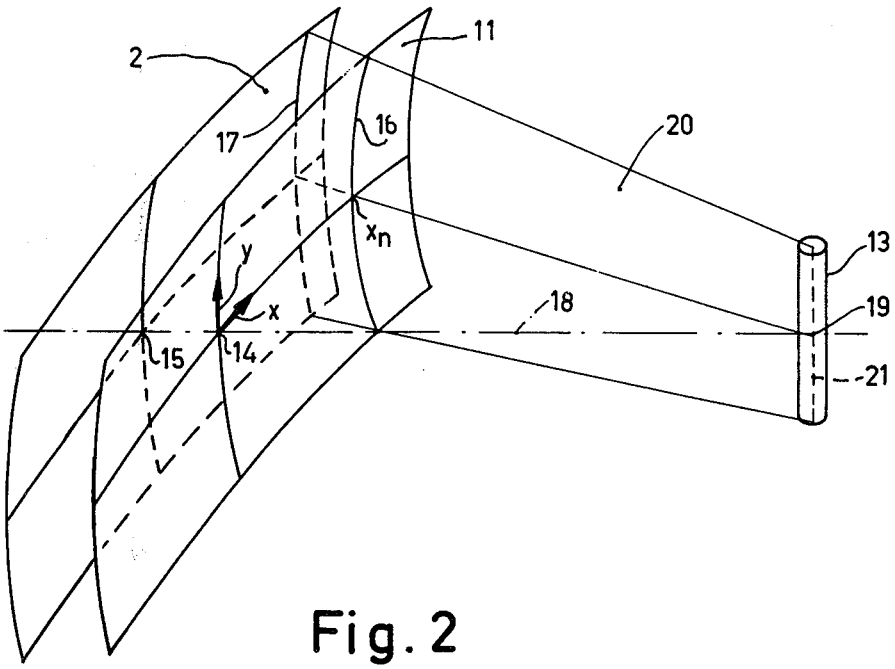
Figure 3:
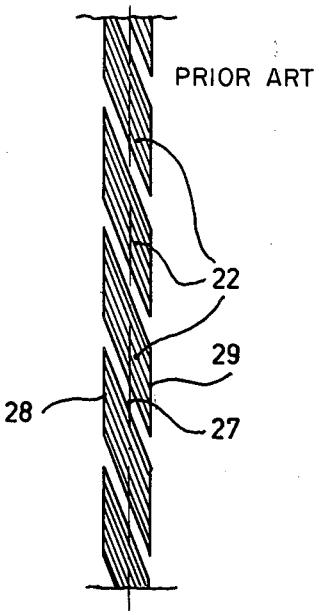

The invention will be described in greater detail with reference to the accompanying drawing, of which, FIG. 1 shows a cathode-ray tube for displaying coloured pictures according to the invention, FIG. 2 is a diagrammatic representation to illustrate the invention, FIG. 3 shows the light pattern which is obtained upon exposure through the apertures of a conventional colour selection electrode.

Figure 4:
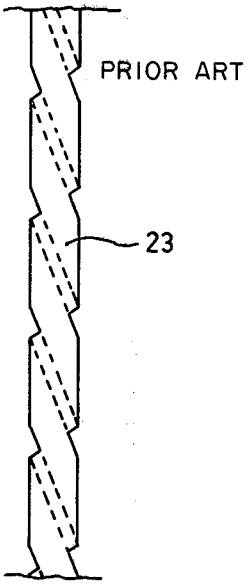
Figure 5:
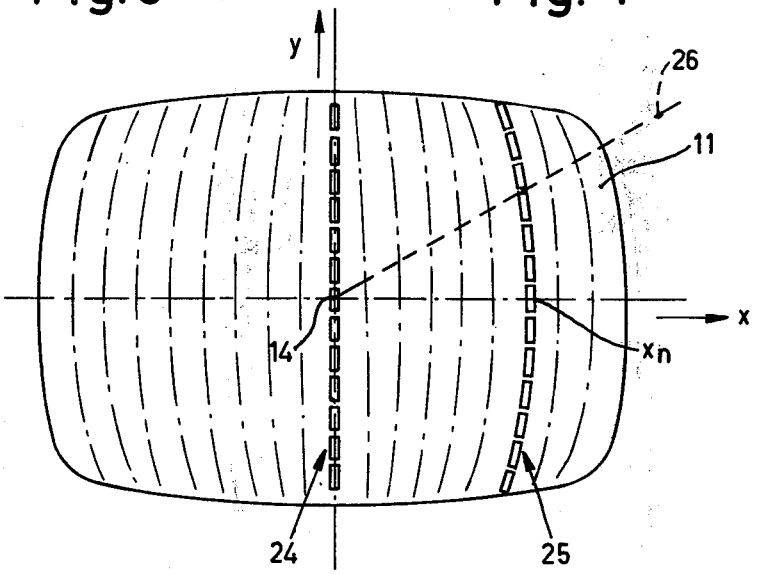

FIG. 4 shows the shape of the linear luminescent regions which are the result of FIG. 3, and FIG. 5 is an elevation of a colour selection electrode of a tube according to the invention.

The cathode-ray tube for displaying coloured pictures shown in FIG. 1 comprises a glass envelope 1 consisting of a face plate 2, a cone 3 and a neck 4. An electron gun 5 for generating three electron beams 6, 7 and 8 is arranged in the neck 4. Prior to their deflection the electron beams 6, 7 and 8 are located in one plane which in FIG. 1 corresponds to the plane of the drawing. The tube furthermore comprises deflection coils 9 for scanning, by means of the electron beams 6, 7 and 8, the display screen 10 which is provided on the inside of the face plate 2. The deflection region of the electron beams 6, 7 and 8 is denoted by the arrow 30. The scanning occurs according to a frame the lines of which are parallel to the plane of the drawing, and in normal use of the tube are horizontal. Substantially parallel to and at a short distance from the display screen 10 a colour selection electrode 11 (shadow mask) is arranged. The shadow mask 11 comprises a large number of elongate apertures 10 which are arranged in rows having a main direction at right angles to the plane of the drawing. The pattern of the apertures 12 is shown in FIG. 5. The display screen 10 comprises a large number of linear phosphor regions which are arranged in triplets each comprising a green, a blue and a red luminescing phosphor strip. A row of apertures in the shadow mask corresponds with each triplet in such manner that the electron beam 6 impinges only on green luminescing phosphor strips and the beams 7 and 8 impinge only on red and blue luminescing phosphor strips, respectively. The display screen 10 is manufactured by providing a photosensitive layer with green luminescing phosphor on the face plate 2 and exposing to the light of an elongate light source which is arranged in the deflection point of the electron beam 6, the shadow mask 11 being mounted in operative proximity to the face plate 2. After developing the photosensitive layer, a pattern of green luminescing phosphor strips is obtained in the places where the electron beam 6 impinges upon the display screen 10. The blue and red luminescing phosphor strips are provided in the same manner.

FIG. 2 shows diagrammatically an elongate substantially linear light source 13 which exposes a face plate 2 with a photosensitive layer via the shadow mask 11. A row of elongate apertures in the shadow mask 11 is denoted by the line 16. The light of the light source 13 which impinges upon the face plate 2 via said row of apertures is denoted by the line 17. The main axis of the tube is denoted by 18 and intersects the shadow mask 11 in the point 14 and the face plate 2 in the point 15. The face plate 2 and the shadow mask 11 are considered spherical to an approximation with a radius R which is much larger than the distance from the point of intersection 19 of the light source 13 with the axis 18 to the point 14. The distance between the points 14 and 19 is defined as L. A phosphor line with straight edges is obtained when the line 17 is the intersection of a flat plane 20 with the face plate 2, in which the flat plate 20 comprises the axis 21 of the light source 13. The shape of the line 16 is therefore determined by the intersection of the plane 20 with the shadow mask 11. It has been found that as a result of this curved rows of elongate apertures in the shadow mask are necessary, the concave side of which is directed towards the center 14 of the shadow mask 11.

FIG. 3 shows diagrammatically how the light source 13 is reproduced on the face plate 2, when said condition is not satisfied. In that case the light source 13 and the rows of elongate apertures in the shadow mask intersect each other everywhere at an acute angle except at the $x$-axis. The light spots 22 on the photosensitive layer correspond to a part of a row of elongate apertures in the shadow mask, the intermediate spaces are caused by the bridges between the apertures. The center line 27 is the reproduction of the center line of the row of apertures in the shadow mask through the central point of the light source. The left-hand edge 28 is the reproduction of the left-hand edge of the row of apertures through the lower end of the light source and the edge 29 is the reproduction of the right-hand edge of the row of apertures through the upper end of the inclined light source. In practice, the light spots slightly merge into each other so that an undulated phosphor line 23 is formed as is shown in FIG. 4.

The desired shape of the rows of apertures in the shadow mask 11 can be calculated as follows. FIG. 2 shows a coordinate system having an $x$-axis and an $y$-axis intersecting at the origin 14. The shadow mask 11 is considered substantially spherical with radius R. Furthermore the distance L between the points 14 and 19 is known and is considerably smaller than R. Taking the above stated approximation into consideration, the shape of the line 16 is then given by $x = x_n\ (1 - y^2 /2RL)$, where $x_n$ is a parameter which is determined by the distance between the origin 14 and the point of intersection of the line 16 with the $x$-axis.

FIG. 5 shows the shadow mask 11 as well as two rows of elongate apertures 24 and 25 and the center lines of a number of other rows. Furthermore, the $x$-axis and the $y$-axis are shown in FIG. 5. As a matter of fact, the row of apertures 24 through the center 14 of the shadow mask is straight as follows immediately by considering FIG. 2, and from the stated formula it follows in connection with $x_n = 0$ and hence $x = 0$ for each $y$. The center line of the row 25 is determined by $x = x_n(1-y^2 / 2RL)$. It is to be noted that said formula can be applied in practice to the shape of the rows of apertures in a flat plate which, after providing the apertures, is made spherical with a radius R. Actually, by the conventionally used method of bulging the shape of the rows is hardly influenced. It should be noted that the shadow mask 11 in practice is not truly spherical; the deviations from the truly spherical shape can be determined by all kinds of causes which are not related to the invention.

The described shape of the rows of apertures in the shadow mask has for its result that their mutual distance in the $x$-direction, the pitch of the shadow mask, is not constant throughout the shadow mask. The pitch decreases with increasing absolute value of $y$ and this effect is most prominent at the ends of the $x$-axis. When the pitch along the $x$-axis is maintained constant this has for its result that the pitch in the corners becomes needlessly small, which is detrimental to the colour purity at that area. This is counteracted by causing the pitch to increase towards the ends of the $x$-axis, for example in such manner that the pitch is constant along the diagonal 26. Therewith the variation of the pitch is mainly restricted to the regions at the ends of the $x$-axis.

What is claimed is:

1. A cathode-ray tube for displaying colored pictures comprising in an evacuated envelope means to generate at least two electron beams the axes of which are located in one flat plane, means to deflect said electron beams in a predetermined deflection region, a display screen comprising a large number of linear regions extending in a transverse direction to said plane and each luminescing in a different color, and a color selection electrode which is curved in two directions and comprises a large number of elongate apertures which are arranged in rows assigned to corresponding linear luminescent regions, said electron beams being each associated with luminescent regions of one color by means of the said color selection electrode, the rows of apertures on either side of a central row being curved such that the center line of each of the said rows of apertures is located substantially in a flat plane coinciding with a line which, in the deflection region, intersects the said flat plane through the electron beams at right angles, and the pitch between said rows of said apertures increasing from the center of the color selection electrode toward the edges when measured along a line through the center and at right angles to said rows, and being substantially constant when measured along a diagonal of the color selection electrode.

* * * * *